US006276432B1

(12) United States Patent
Thompson et al.

(10) Patent No.: US 6,276,432 B1
(45) Date of Patent: Aug. 21, 2001

(54) DIRECTIONAL SOLIDIFICATION METHOD AND APPARATUS

(75) Inventors: Dennis J. Thompson, Whitehall; John R. Brinegar, Muskegon, both of MI (US)

(73) Assignee: Howmet Research Corporation, Whitehall, MI (US)

( * ) Notice: Subject to any disclaimer, the term of this patent is extended or adjusted under 35 U.S.C. 154(b) by 0 days.

(21) Appl. No.: 09/329,735

(22) Filed: Jun. 10, 1999

(51) Int. Cl.[7] ..... B22D 27/04
(52) U.S. Cl. ..... 164/122.1; 164/338.1
(58) Field of Search ..... 164/122.1, 122.2, 164/338.1

(56) References Cited

U.S. PATENT DOCUMENTS

| | | | |
|---|---|---|---|
| 3,714,977 | 2/1973 | Terklesen . | |
| 4,108,236 | 8/1978 | Salkeld | 164/338 R |
| 4,712,604 | 12/1987 | Sawyer | 164/513 |
| 4,763,716 | 8/1988 | Graham et al. | 164/122.1 |
| 4,773,467 | 9/1988 | Graham et al. | 164/122.1 |
| 4,774,992 | 10/1988 | George | 164/122.1 |
| 4,819,709 | 4/1989 | Lallement . | |
| 5,275,228 | 1/1994 | Wortmann et al. | 164/122.2 |
| 5,429,176 | 7/1995 | Atkinson et al. | 164/412 |
| 5,607,007 | 3/1997 | Chandley | 164/122.2 |

*Primary Examiner*—Kuang Y. Lin

(57) ABSTRACT

Method as well as apparatus for DS casting using a multi-stage thermal baffle disposed proximate a lower end of a DS casting furnace. The thermal baffle comprises a fixed primary baffle disposed at the lower end of the casting furnace and a secondary baffle initially releasably disposed adjacent and below the primary baffle prior to withdrawal of the melt-filled mold from the casting furnace. The primary baffle includes a primary aperture oriented perpendicular to the mold withdrawal direction and having a cross-sectional configuration tailored to accommodate a relatively large exterior region or profile of the melt-filled mold, such as a relatively wide platform region of a mold for making a turbine blade or vane. The secondary baffle includes a secondary aperture also oriented perpendicular to the mold withdrawal direction and having a cross-sectional configuration tailored to accommodate a relatively smaller exterior region or profile of the melt-filled mold, such as a narrower airfoil region of a mold for making a turbine blade or vane. The secondary baffle remains adjacent and immediately below the primary baffle during withdrawal of the mold from the furnace until the relatively larger region of the melt-filled mold passes through the primary aperture in a manner to release or disengage the secondary baffle from a temporary baffle support means to allow the secondary baffle to drop or move downwardly onto the chill plate for continued movement therewith as the melt-filled mold continues to be withdrawn from the furnace.

15 Claims, 2 Drawing Sheets

DIRECTIONAL SOLIDIFICATION METHOD AND APPARATUS

BACKGROUND OF THE INVENTION

The present invention relates to directional solidification apparatus and processes wherein heat is removed unidirectional from a melt in a mold to form a columnar grain or single casting.

BACKGROUND OF THE INVENTION

In the manufacture of components, such as nickel base superalloy turbine blades and vanes, for gas turbine engines, directional solidification (DS) investment casting techniques have been employed in the past to produce columnar grain and single crystal casting microstructures having improved mechanical properties at high temperatures encountered in the turbine section of the engine.

In the manufacture of turbine blades and vanes using the well known DS casting "withdrawal" technique where a melt-filled investment mold residing on a chill plate is withdrawn from a casting furnace, a stationary thermal baffle has been used proximate the bottom of the casting furnace to improve the unidirectional thermal gradient present in the molten metal or alloy as the investment mold is withdrawn from the casting furnace. The baffle reduces heat loss by radiation from the furnace and the melt-filled mold as the mold is withdrawn form the casting furnace.

In attempts to improve the thermal gradient, various baffle constructions have been proposed such as, for example, described in U.S. Pat. No. 3,714,977 where a movable upper baffle and fixed lower baffle are used and in U.S. Pat. No. 4,108,236 where a fixed baffle and a floating baffle below the fixed baffle and floating on a liquid coolant bath disposed below the furnace are used.

U.S. Pat. No. 5,429,176 discloses a cloth-like baffle that has a slit or other opening with peripheral edges that engage the melt-filled mold during withdrawal from the furnace.

U.S. Pat. No. 4,819,709 discloses first and second opposing, movable heat shields having overlapping regions that define an aperture through which the melt-filled mold is withdrawn. The heat shields are movable toward or way from one another in a horizontal plane.

It is an object of the present invention to provide multi-stage thermal baffles for DS apparatus and processes that allows tailoring and improvement of the thermal gradient in the molten metal or alloy for different mold geometries.

SUMMARY OF THE INVENTION

The present invention provides apparatus as well as method for DS casting using multi-stage thermal baffle system disposed at a lower end of a DS casting furnace. The multi-stage thermal baffle system comprises a fixed primary baffle disposed at the lower end of the casting furnace and one or more secondary baffles initially releasably disposed adjacent and below the primary baffle prior to withdrawal of the melt-filled mold from the casting furnace. The primary baffle includes a primary aperture oriented perpendicular to the mold withdrawal direction and having a cross-sectional configuration tailored to accommodate a relatively large exterior region or profile of the melt-filled mold, such as a relatively wide region of a mold corresponding to a platform region of a turbine blade or vane. Each secondary baffle includes a secondary aperture also oriented perpendicular to the mold withdrawal direction and having a cross-sectional configuration tailored to accommodate a relatively smaller exterior region or profile of the melt-filled mold, such as a narrower region of a mold corresponding to an airfoil of a turbine blade or vane.

A lower level secondary baffle remains adjacent and immediately below the primary baffle during withdrawal of the mold from the furnace until the relatively larger region of the melt-filled mold passes through the primary aperture to engage and release the secondary baffle from a temporary baffle support to allow the secondary baffle to drop or move downwardly onto the chill plate for continued movement therewith as the melt-filled mold continues to be withdrawn from the furnace.

An additional upper level thermal baffle may be used and placed above the mold and the lower level baffle. For example, the upper level baffle resides at a position above a platform region of the melt-filled mold to improve thermal gradient in the molten metal above the platform region.

Such multi-stage thermal baffle system allows tailoring and improvement of the thermal gradient in the molten metal or alloy as the mold is withdrawn form the casting furnace. In particular, the baffle apertures can be tailored to particular mold exterior profiles or configurations as necessary to improve the thermal gradient for different mold/component geometries.

DETAILED DESCRIPTION OF THE INVENTION

Figure 1:
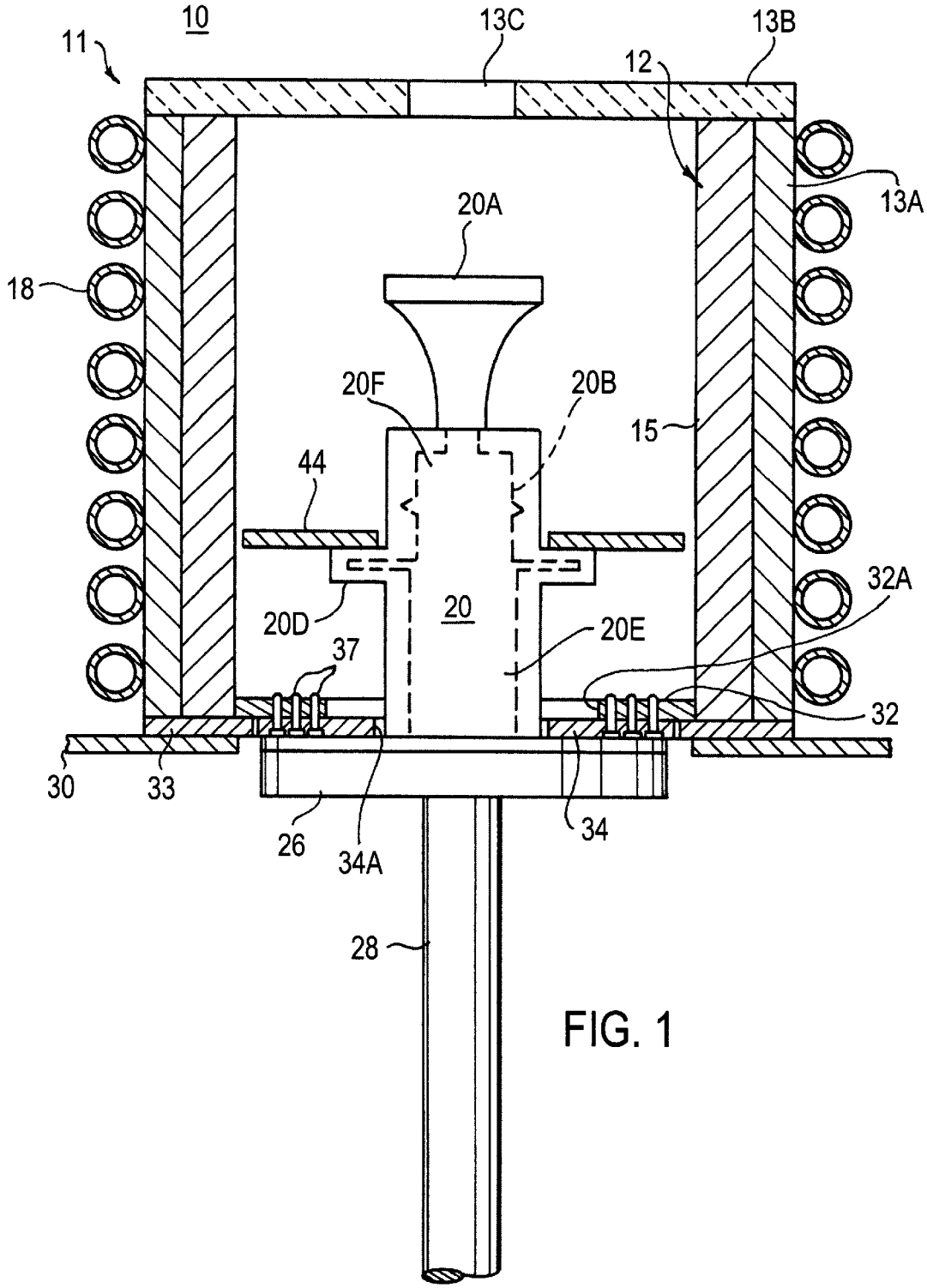
FIG. 1 is a schematic cross-sectional view of a DS casting apparatus in accordance with an embodiment of the invention.

The present invention provides in one embodiment a two stage baffle for use in well known DS withdrawal casting apparatus and processes and is especially useful, although not limited, to casting nickel, cobalt and iron base superalloys to produce a columnar grain or single cast microstructure. Referring to FIG. 1, casting apparatus in accordance with an embodiment of the invention for DS casting nickel, cobalt and iron base superalloys to produce columnar grain or single cast microstructure includes a vacuum casting chamber 10 having a casting furnace 11 disposed therein in conventional manner. Thermal insulation members 13*a*, 13*b* form a furnace enclosure. Positioned within the tubular thermal insulation member 13*a* is an inner solid graphite tubular member 15 forming a susceptor that is heated by energization of the induction coil 18. The thermal insulation member 13*b* includes an aperture 13*c* through which molten metal or alloy, such as a molten superalloy, can be introduced into the mold 20 from a crucible (not shown) residing in the chamber 10 above the casting furnace 11 in conventional manner.

An induction coil 18 is supported on support legs 14 adjacent the thermal insulation members 13*a*, 13*b* and is energized by a conventional electrical power source (not shown). The induction coil 18 heats a tubular graphite susceptor 15 disposed interiorly thereof. After the empty mold 20 is positioned in the furnace 12, the mold is preheated to a suitable casting temperature to receive the melt by the heat from the susceptor 15. The mold 20 typically comprises a conventional ceramic investment shell mold formed by the well know lost wax process to include a pour cup 20*a* that receives the melt from the crucible and that communicates to one or more mold cavities 20*b* in the mold. Each mold cavity 20*b* communicates to a chill plate 26 at an open bottom end of each mold cavity in conventional manner to provide unidirectional heat removal from the melt residing in the mold and thus a thermal gradient in the melt in the mold extending along the longitudinal axis of the mold. In casting single crystal components, a crystal selector (not shown), such as pigtail, will be incorporated into the mold above the open lower end thereof to select a single crystal for propagation through the melt, all as is well known. The mold 20 is formed with an integral mold base 20*c* that rests on the chill plate 26 as shown and that can be clamped thereto in conventional manner if desired. The chill plate resides on a ram 28 raised and lowered by a fluid actuator (not shown).

In the DS casting of gas turbine engine blades or vanes, the ceramic shell mold 20 will have an exterior profile or configuration having a relatively large exterior platform region or profile 20*d* corresponding to the platform portion of the blade or vane to be cast. The mold 20 also will have an exterior profile or configuration having a relatively smaller or narrower exterior airfoil region or profile 20*e* corresponding to the airfoil portion of the blade or vane to be cast.

In accordance with an illustrative embodiment of the invention, a two stage thermal baffle is provided and comprises a fixed annular primary baffle 32 and a secondary baffle 34. Primary baffle 32 is disposed at the lower end of the casting furnace 12 on a graphite annular support ring 33 as shown, which, in turn, is supported on an annular copper support ring 30 connected to the walls of the vacuum chamber 10. A lower secondary baffle 34 is initially releasably disposed adjacent and below the primary baffle 32 prior to withdrawal of the melt-filled mold from the casting furnace 12.

The primary baffle 32 includes a primary aperture 32*a* oriented perpendicular to the mold withdrawal direction (vertical direction in FIG. 1) and having a cross-sectional configuration tailored to accommodate movement of the relatively large exterior platform region or profile 20*d* of the melt-filled mold 20 therepast with only a small gap (e.g. ½ inch) present between the region 20*d* and inner periphery of the baffle 32. The primary baffle 32 typically is made of graphite material, although other refractory materials can be used.

The lower secondary baffle 34 includes a secondary aperture 34*a* oriented perpendicular to the mold withdrawal direction and having a cross-sectional configuration tailored to accommodate movement of the relatively smaller airfoil exterior region or profile 20*e* of the melt-filled mold 20 therepast with only a small gap (e.g. ½ inch) present between the region 20*e* and inner periphery of the baffle 34. The secondary baffle 34 typically is made of graphite material, although other refractory materials can be used. The secondary baffle 34 initially is releasably mounted adjacent and below the primary baffle 32 using releasable baffle fastening means such as releasable metal, such as stainless steel pins, staples or other fasteners 37 extending from the secondary baffle 34 frictionally into the primary baffle 32. The fastening means are adapted to be frictionally pulled out of the primary baffle 32 or, alternately, to break off or otherwise release/disengage to allow movement of the secondary baffle 34 in response to engagement of the baffle 34 by the relatively large exterior platform region or profile 20*d* as the mold 20 is withdrawn from the furnace 11 by lowering of the ram 28. Alternately, the secondary baffle 34 can be held in the position shown by a clamp mechanism (not shown) as a releasable support means that would release the baffle 34 just prior to the baffle's 34 being contacted by the mold flange 20*d*. The secondary baffle 34 remains adjacent and immediately below the primary baffle 32 during withdrawal of the mold from the furnace until the relatively larger platform region 20*d* of the melt-filled mold 20 passes through the primary aperture 32*a* and engages therewith to release or disengage the secondary baffle 34 from the temporary baffle support means to allow the secondary baffle to drop or move downwardly onto the chill plate 26 for continued movement therewith as the melt-filled mold 20 continues to be withdrawn from the furnace.

Figures 2A, 2B, 2C:
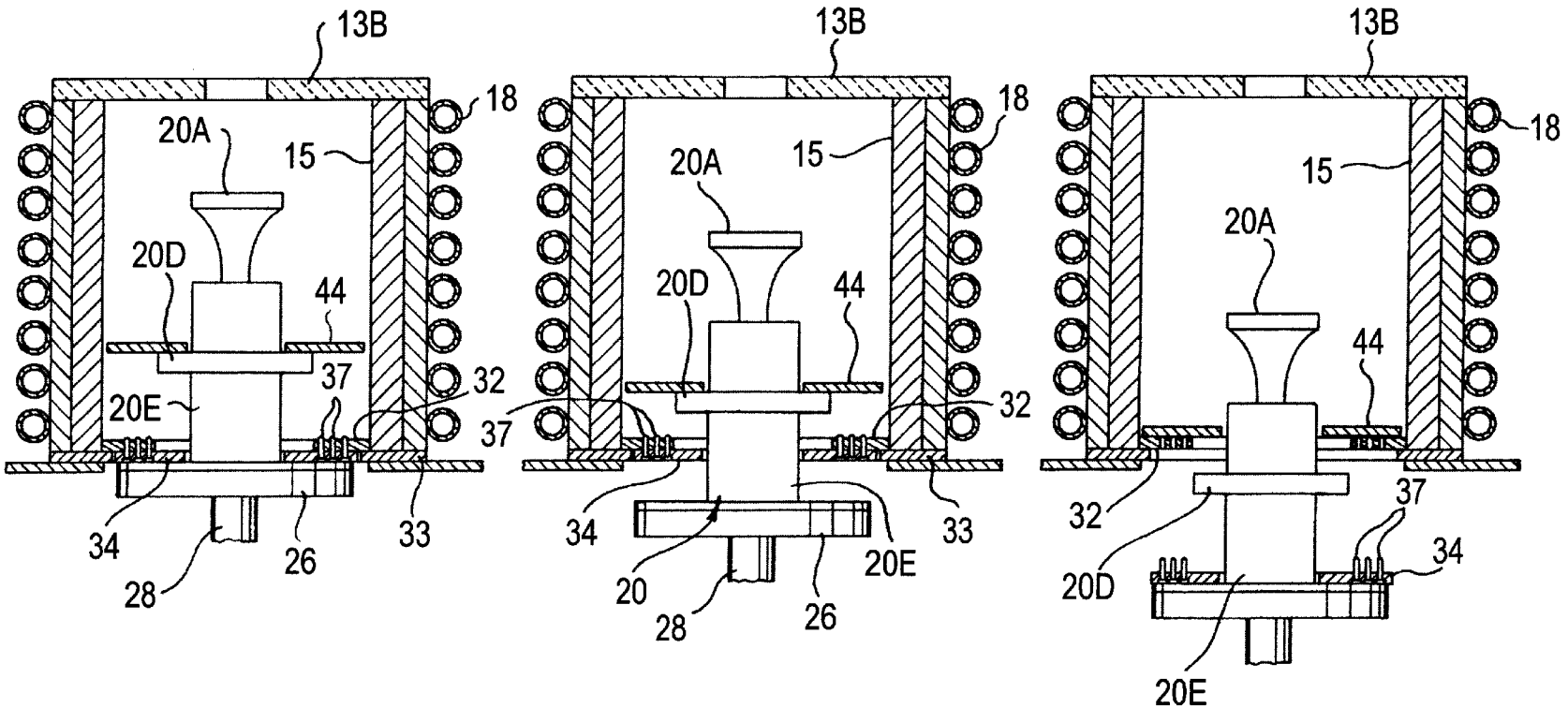
FIGS. 2A, 2B, and 2C are schematic views illustrating the initial position of the secondary baffle and subsequent movement thereof initiated by the relatively larger exterior region or profile of the melt-filled mold as it withdrawn from the casting furnace.

The initial position of the secondary baffle 34 is illustrated schematically in FIGS. 2A and 2B. The subsequent movement of the secondary baffle 34 away from the primary baffle 32 and dropping onto the chill plate 26 as a result of engagement by the mold platform region or profile 20*d* is illustrated schematically in FIG. 2C.

In operation, an empty mold 20 is positioned in the furnace 11 by upward movement of the ram 28. The induction coil 18 is energized to preheat via susceptor the mold 20 to a suitable casting temperature. The mold is filled with molten metal or alloy from the crucible above the furnace. Then, the melt-filled mold is withdrawn downwardly relative to the furnace 12 by lowering of the ram 28 at a controlled withdrawal rate to establish a thermal gradient in the melt to achieve either columnar grain or single crystal solidification. The baffles 32, 34 cooperate during mold withdrawal of the airfoil region or profile 20*e* through apertures 32*a*, 34*a*, FIGS. 2*a*, 2B, to improve the thermal gradient in the melt. The primary baffle 32 is operative as the platform region or profile 20*d* passes through aperture 32*a*. Then, the secondary baffle 34 is released or disengaged and caused to drop or move downwardly onto the chill plate 26 for movement therewith after the platform region or profile 20*e* passes through the aperture 32*a* to allow for continued movement of the melt-filled mold 20 from the furnace. For example, the releasable fasteners 37 are pulled out of the primary baffle 32 and travel with the secondary baffle 34 after the platform region or profile 20*e* passes through the aperture 32*a*.

The multi-stage thermal baffle system described herebove is advantageous to allow tailoring and improvement of the thermal gradient in the molten metal or alloy to accommodate different mold and thus component geometries. The baffle apertures can be tailored to particular mold exterior profiles or configurations as necessary to improve the thermal gradient for different component geometries.

In casting the next empty mold 20, the empty mold is positioned on the chill plate 26. The secondary baffle 34 is reused or a new one is used, positioned on the chill plate, and raised upwardly on the chill plate so that the fasteners 37 will be inserted into the primary baffle 32 as shown in FIG. 1 or held by the baffle clamping mechanism (not shown) for repeating the casting and mold withdrawal sequence to for columnar grain or single crystal solidification.

In another embodiment of the invention, an additional upper thermal baffle 44 may be used and placed about the melt-filled mold 20 above the aforementioned lower baffles 32, 34. For example, the upper baffle 44 resides at a position above a platform region 20*d* of the melt-filled mold 10 to improve thermal gradient in the molten metal above the platform region 20*d* where a shank region 20*e* and root region 20*f* of the mold cavity 20*d* of the gas turbine blade or vane. The baffle 44 includes an aperture 44*a* that is closely configured to the maximum or largest cross-sectional configuration of the melt-filled mold 20 above the platform region 20*d* (providing a gap of ½ inch between the baffle 44 and mold exterior above platform region 20*d*) to improve thermal gradient as described below. The baffle 44 can be placed on the platform region 20*d* after the mold 20 is positioned in the furnace 12 and prior to withdrawal of the melt-filled mold 20 from the furnace. The baffle 44 also can placed atop the baffles 32, 34 by insertion through apertures 32*a*, 34*a* and then registered with the mold configuration in a manner to allow the baffle 44 to be picked up by the mold platform region 20*d* as it is raised into the furnace 12 by ram 28. For example, the baffle 44 can have an asymmetrical outer cross-sectional profile (e.g. a rectangular shape) that can be oriented to pass through the apertures 32*a*, 34*a* and then rotated to a different orientation after insertion in the furnace that will not pass through the apertures 32*a*, 34*a* and that will allow the baffle to be picked by the mold platform 20*d* as the mold rises on ram 28 into the furnace 12. The baffle 44 also can be placed on the mold 20 by removing the thermal insulation member 13*b* and placing the baffle on the mold. The outer dimension of the baffle 44 is spaced from the interior vertical wall of the furnace 12 to allow the baffle 44 to move with the melt-filled mold 20. The baffle 44 can comprise graphite material.

As the mold is withdrawn for the furnace 12, the baffle 44 moves downward with the mold 20 and eventually comes to rest on the primary upper baffle 32 as shown in FIG. 2C with further mold withdrawal from the furnace to improve the thermal gradient in the molten metal in the mold above the platform region 20*d* thereof; i.e. to improve the thermal gradient in the molten metal in the shank region 20*e* and root region 20*f* of the mold. After the mold is withdrawn from the furnace 12, the baffle 44 can be removed from the furnace 12 by rotating it back to the orientation that will pass through the apertures 32*a*, 34*a* to enable baffle removal.

Although the invention has been described above with respect to a releasable lower baffle 34 and an upper baffle 44, the invention is not so limited and can be practiced using additional releasable lower baffles (not shown) nested with or placed below lower baffle 34 and having apertures, such as similar to aperture 34*a*, of smaller cross-sectional size to accommodate different mold cross-sectional features as the mold 20 is withdrawn form the furnace. Such one or more lower baffles can be fastened to the lower baffle 34 or to the fixed baffle 32 through the lower baffle 34 using techniques described. Similarly, additional upper baffles (not shown) having different size apertures can be nested with or placed adjacent upper baffle 44 depending on the particular mold configuration to accommodate different mold cross-sectional features. It is to be understood that the invention has been described with respect to certain specific embodiments thereof for purposes of illustration and not limitation. The present invention envisions that modifications, changes, and the like can be made therein without departing from the spirit and scope of the invention as set forth in the following claims. For example, additional releasable lower and upper baffles can be nested or placed adjacent respective lower baffle 34 and upper baffle 34 depending on the particular mold configuration to accommodate different mold cross-sectional features.

We claim:

1. Directional solidification casting apparatus comprising a casting furnace having an open lower end through which a melt-filled mold disposed on a chill member is moved, a fixed primary baffle disposed at the lower end of said casting furnace, said primary baffle including a primary aperture oriented perpendicular to the mold withdrawal direction and having a cross-sectional configuration tailored to accommodate a relatively large exterior region of the melt-filled mold, and a secondary baffle releasably disposed initially in a position adjacent and below the primary baffle prior to withdrawal of the melt-filled mold from said casting furnace, said secondary baffle including a secondary aperture oriented perpendicular to the mold withdrawal direction and having a cross-sectional configuration tailored to accommodate a relatively smaller exterior region of the melt-filled mold, said secondary baffle remaining in said position during withdrawal of the mold from the furnace until said relatively large region passes through said primary aperture and being released from said position thereafter to move downwardly onto said chill plate for continued movement therewith as the melt-filled mold continues to be withdrawn from the furnace.

2. The apparatus of claim 1 wherein said primary aperture has a configuration to accommodate a relatively large platform region of said mold corresponding to a platform region of a gas turbine engine blade or vane.

3. The apparatus of claim 2 wherein said secondary aperture has a configuration to accommodate a relatively smaller airfoil region of said mold corresponding to an airfoil region of the gas turbine engine blade or vane.

4. The apparatus of claim 1 including releasable fastening means for connecting said secondary baffle to said primary baffle.

5. The apparatus of claim 4 wherein the fastening means comprises a plurality of fastener members releasably engaged with said primary baffle in a manner to disengage therefrom when said relatively large region passes through said primary aperture.

6. The apparatus of claim 1 including a further baffle above the primary baffle movable with the mold and having a baffle aperture oriented perpendicular to the mold withdrawal direction, said baffle aperture having a cross-sectional configuration tailored to accommodate a relatively smaller exterior region of the melt-filled mold above said relatively large exterior region of the melt-filled mold.

7. The method of claim 5 wherein the fastener members are frictionally engaged with said primary baffle.

8. Method of casting, comprising withdrawing a relatively small exterior region of a melt-filled mold from an end of a casting furnace first through a primary aperture of a fixed primary baffle and then through a secondary aperture of a secondary baffle releasably disposed at said end of said casting furnace downstream from said primary baffle and then withdrawing a relatively larger exterior region of said melt-filled mold through said primary aperture and then through said secondary baffle including releasing said secondary baffle for movement with said melt-filled mold.

9. The method of claim 8 wherein said primary aperture has a configuration to accommodate a relatively large platform region of said mold corresponding to a platform region of a gas turbine engine blade or vane.

10. The method of claim 8 wherein said secondary aperture has a configuration to accommodate a relatively smaller airfoil region of said mold corresponding to an airfoil region of the gas turbine engine blade or vane.

11. The method of claim 8 including releasing fastening means connecting said secondary baffle to said primary baffle to release said secondary baffle.

12. The method of claim 8 including positioning a further baffle above the primary baffle and having a baffle aperture oriented perpendicular to the mold withdrawal direction, said baffle aperture having a cross-sectional configuration tailored to accommodate a relatively smaller exterior region of the melt-filled mold above said relatively larger exterior region of the melt-filled mold.

13. The method of claim 8 wherein said secondary baffle is released when said relatively larger exterior region passes through said primary aperture.

14. The method of claim 8 including releasably clamping said secondary baffle at said end of said casting furnace downstream from said primary baffle.

15. The method of claim 14 including releasing said secondary baffle from said clamping for movement with said melt-filled mold.

* * * * *

UNITED STATES PATENT AND TRADEMARK OFFICE

CERTIFICATE OF CORRECTION

PATENT NO. : 6,276,432 B1
DATED : August 21, 2001
INVENTOR(S) : Dennis J. Thompson et al.

It is certified that error appears in the above-identified patent and that said Letters Patent is hereby corrected as shown below:

Column 3,
Line 15, delete "20c".

Column 4,
Line 67, delete "20e".

Column 5,
Line 2, delete "44a".
Line 28, replace "for" with -- from --.
Line 34, delete "20e".

Signed and Sealed this

Seventh Day of May, 2002

*Attest:*

*Attesting Officer*

JAMES E. ROGAN
*Director of the United States Patent and Trademark Office*